United States Patent [19]

Sneider

[11] 4,428,507

[45] Jan. 31, 1984

[54] COLLAPSIBLE CONTAINER WITH ACCORDION PLEATED SIDEWALLS, AIR VENT AND SWIVEL VALVE OUTLET

[76] Inventor: Vincent R. Sneider, 3422 Hallcrest Dr., Atlanta, Ga. 30319

[21] Appl. No.: 390,554

[22] Filed: Jun. 21, 1982

Related U.S. Application Data

[63] Continuation-in-part of Ser. No. 265,150, May 19, 1981, abandoned.

[51] Int. Cl.[3] ..... B65D 35/08; B65D 35/48

[52] U.S. Cl. ..... 222/105; 222/184; 222/185; 222/536; 222/530

[58] Field of Search ..... 604/133, 185, 216, 248, 604/262, 408; 222/105, 107, 181, 184, 185, 536, 548, 206, 530; 248/95, 318, 359, 360; 215/100 A

[56] References Cited

U.S. PATENT DOCUMENTS

| | | | |
|---|---|---|---|
| 2,226,538 | 12/1940 | Swabacker | 604/248 X |
| 3,023,939 | 3/1962 | Gustafson | 222/536 |
| 3,901,399 | 8/1975 | McPhee | 215/100 A |
| 4,066,080 | 1/1978 | Sneider | 604/216 |
| 4,068,662 | 1/1978 | Sneider | 604/216 X |

*Primary Examiner*—David A. Scherbel
*Attorney, Agent, or Firm*—Ralph R. Roberts

[57] ABSTRACT

This invention discloses an improvement in accordion pleated containers used with a controlled discharge valve connected preferably to a flexible and resilient length of tubing. This container includes an air vent which is removably mounted to an opening formed in a top surface portion of the container. An integral handle is carried by this top portion, said handle is folded over for storage and is retained in a flat folded condition by a clip or other type of retaining means. The bottom of this container includes a discharge opening on which is removably mounted a swivel-type fluid cutoff valve. The body of this valve, where mounted to the discharge outlet of the container, has an extending manipulative flange adapted for grasping, shaking and/or agitating the fluid contents of the container. The discharge outlet is shown as offset and central and in one embodiment with the container having a boss on which is adapted to retain a collar made from a lapped strip. The stem of this swivel valve is formed with barbs or ring-type protrusions adapted to retain said resilient tubing. With the swivel valve manipulated to the closed condition the tubing connected thereto may be coiled for storage and/or shipping. This container may be used for a douche fluid, enema fluid or may be used as a storage and delivery means for an intravenous fluid.

16 Claims, 11 Drawing Figures

COLLAPSIBLE CONTAINER WITH ACCORDION PLEATED SIDEWALLS, AIR VENT AND SWIVEL VALVE OUTLET

REFERENCE TO RELATED APPLICATION

This enclosed application is a Continuation-In-Part of my application Ser. No. 265,150 now abandoned.

The application filed herewith includes the showing and description of my application Ser. No. 265,150 as filed May 19, 1981 and includes a further embodiment to show an improvement recently developed.

BACKGROUND OF THE INVENTION

1. Field of the Invention

This invention pertains to a collapsible container with accordion pleated sides and with vent means and a swivel discharge valve.

2. Description of the Prior Art

Containers for douches, syringes, I.V's and the like and accessories used therewith are well known and are widely used in hospitals and in the home. Containers with accordion pleated sidewalls and having a top air vent with a fluid inlet means are also well known. Formed handles molded as a part of the container are shown in applicant's U.S. Pat. No. 4,068,662 as issued Jan. 17, 1978. This patent and others known to applicant have the handles in a fixed and outwardly extending condition as is usually provided in molded containers with thin walls such as those used for water, milk and cider. The lower end of the container in said patent has an attached length of resilient tubing and for storage and cutoff the tubing is bent to a shut condition. This tubing becomes weakened with continued use and long storage periods. The swivel valve of this embodiment does not subject the attached tubing to such destructive abuse. This collapsible container may be assembled for a minimum shut height with the attached tubing coiled for storage and/or shipment.

SUMMARY OF THE INVENTION

This invention may be summarized, at least in part, with reference to its objects. It is an object of this invention to provide, and it does provide, a container having accordion pleated sidewalls which are formed so as to be collapsed into a minimum shut height. The upper surface of this container has a substantially flat end in which is formed an inlet on which is removably mounted a vent valve which can be selectively opened or closed. This top surface also includes an integral handle which may be swung from an erected position to a flat folded condition. This handle is retained in the flat folded condition by a latch means. The container is also formed with a substantially flat bottom in which an outlet is molded. A swivel valve is removably attached to said outlet and a stem portion has means for attaching a resilient length of tubing providing a fluid conductor to a nozzle or other discharge means.

It is a further object of this invention to provide, and it does provide, a swivel valve removably mountable on the discharge outlet of the container. This valve is made of two separately molded members which are pushed together for assembly. The assembled valve when pushed together provides a contiguous friction fit of the swivel stem in the body. In one position this valve provides a full flow condition and when swung into a position of about ninety degrees from a full flow the valve is brought to a shutoff condition. When the valve is swung to or is in the full flow condition the withdrawal of fluid from the container requires that the vent valve on the top be opened sufficiently to prevent developing negative pressure in the container. This swivel valve and the container is adapted for collapsing to provide a minimum shut height.

It is still a further object of this invention to provide, and it does provide, a substantially flat bottom with the container shown with the outlet either offset at one side or substantially centrally disposed so that a support ring made of an assembable strip of plastic may be provided as a support for the collapsible container.

In brief, the container of this invention includes a onepiece molded unit having thin walls formed with accordion pleated sidewalls and containing top and bottom members. The top surface is formed with a threaded inlet and on this inlet and a short distance above the top surface of the container is a bead or protrusion providing a support means for the container during filling. This inlet is closed with an air vent valve selectively closeable to admit or exclude the flow of atmosphere and/or fluid. The top is also formed with a hinged handle integrally molded to the top and movable from an erect to a flat folded condition and position. The top surface is also provided with a latch means which is made as a molded member and disposed to engage and retain said handle when flat folded.

The bottom of this container is provided with an outlet having male threads thereon. To this outlet is removably mounted a swivel valve having a protruding flange formed and integral with the body portion of said valve. This flange may be grasped by the user of the container and with the handle attached to the top surface said container may be agitated or shook for mixing of the contents. The swivel valve is made of plastic and is assembled with a forcing motion to bring the arcuate surface of the swivel stem into a frictional engagement with a compatible surface formed in the body of the valve. In one position the swivel valve is in fluid flow condition and when the swivel portion is swung to a position substantially normal to the bottom, fluid flow through the valve is shut off. This swivel valve has the stem portion formed with barbs or rings adapted to retain a length of resilient tubing. The swivel valve and attached tubing may be swung to a fluid flow cutoff condition and the tubing coiled to provide a minimum shut height condition.

This container may be used for the storage of or mixing of fluids and is particularly adapted for storage in a collapsed condition with an attached length of tubing. The manipulating of the swivel valve to allow the attached length of resilient tubing to be coiled without flattening is particularly noted. The handle and protruding flange enables the container to be grasped and shaken when filled with fluid. To the extent applicable three U.S. patents issued to the applicant are incorporated by reference. These include U.S. Pat. No. 4,014,332 as issued on Mar. 20, 1977; U.S. Pat. No. 4,066,080 as issued Jan. 2, 1978 and U.S. Pat. No. 4,068,662 as issued Jan. 17, 1978.

In one embodiment the collapsible container is shown with a centrally disposed outlet which is used for manipulation. When said container is filled with fluid an assembled support is provided so that the container may be placed or positioned in an upright attitude on a table or the like. This support means allows the contents of the container to be flowed to the user. This support is made of a thin strip of plastic with notched cut portions providing a lap joint securing means. This support strip in an assembled condition has a dispensing passageway where and when other means such as a space in the support table is not available for the conducting through the attached tubing.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of the collapsible container with accordion pleated side portions as adopted for use for controlled fluid discharge and showing a preferred means for fluid flow and container storage. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names are intended to be generic in their application. Corresponding reference characters refer to like members throughout the several figures of the drawings.

EMBODIMENT OF FIG. 1

Figure 1:
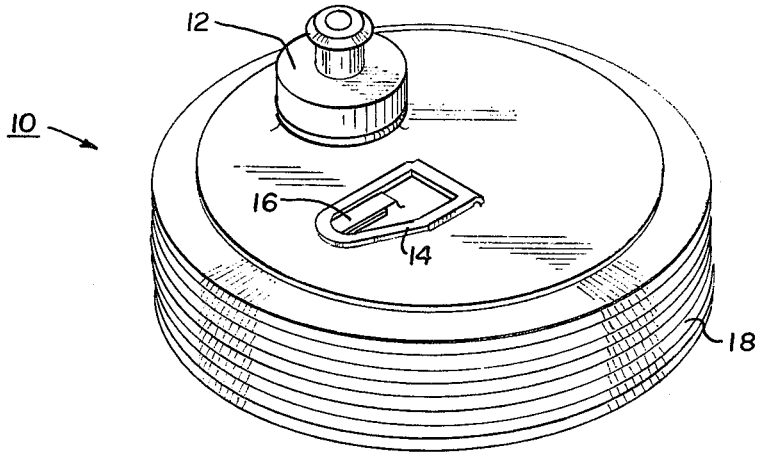
FIG. 1 represents an isometric view of a collapsible container having accordion pleated side portions, this view looking toward or at the top end of the container and showing an integrally attached and selectively secured handle, the handle shown in a folded flat, secured condition and position.

Referring next to the drawings and in particular to FIG. 1 it is to be noted that a container with accordion pleated sides is identified as 10. This container has its upper inlet closed with a valve 12 which is selectively actuated to an opened or closed condition to admit or exclude atmosphere into the interior of the container. This valve may be similar to that shown and described in applicant's U.S. Pat. No. 4,066,080 as issued Jan. 3, 1978. The top of this container also includes an integral handle 14 which is selectively movable to a flat folded condition as shown or may be raised so as to be grasped by a user as in FIG. 4. In the flat folded condition the handle 14 is retained by an integrally molded catch 16. The container is molded with accordion sides 18 which are better seen in FIGS. 2 and 4 to be described hereinafter.

EMBODIMENT OF FIG. 2

Figure 2:
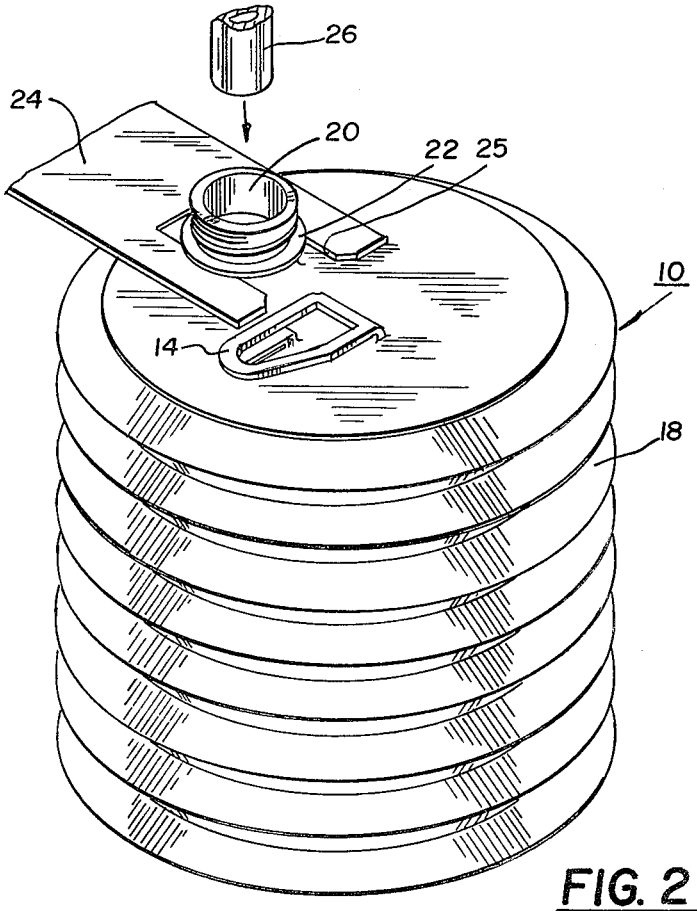
FIG. 2 represents an isometric view of the collapsible container of FIG. 1 with the container now in an expanded condition and arranged for filling with a liquid, said container disposed below a discharge spout and with the container supported by a leaf member, the U-shaped end of said leaf engaging a shoulder portion of the top opening with the discharge spout movable toward and to a top opening provided by the container.

In FIG. 2 the air control valve 12 has been removed to expose a threaded inlet 20. This inlet has a lower shoulder or lip 22 which is spaced a little bit above the container top so as to permit positioning of the container onto a support 24 having a U-shaped opening 25. This support 24 is preferably of sheet metal of sufficient strength to carry the container as and when filled with liquid. Also shown in this view is a filling spout 26 which is adapted to enter into inlet 20 and if desired into the interior of the container. It is noted that the inlet 20 is formed toward the side of the top of the container so that manipulation and ease of removal of the filled container may be by a raised handle 14. In the flat folded condition of FIG. 2 the handle 14 does not obstruct the use of the U-shaped support and ease of filling is contemplated.

EMBODIMENT OF FIG. 3

Figure 3:
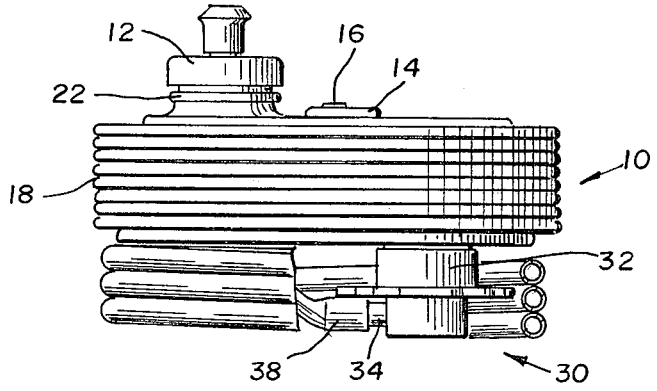
FIG. 3 represents a side view, partly diagrammatic, and showing the container in the collapsed condition of FIG. 1 and in condition for storage and/or shipment and with an attached discharge hose coiled for shipment and/or storage.

In FIG. 3 it is to be noted that the container 10 is shown in the collapsed condition as for storage and/or shipment. The handle 14 is folded flat and is secured by catch 16. The air valve 12 is mounted on the threaded inlet on the top of said container. A fluid flow cutoff valve shown and explained in conjunction with FIGS. 5, 6, 7 and 8 is generally identified as 30. This valve includes a body 32 and a swivel stem portion 34. This swivel stem includes a fluid conduit or path and this swivel portion is shown with an attached resilient and flexible tubing 38 which is wound into a coiled condition.

EMBODIMENT OF FIG. 4

Figure 4:
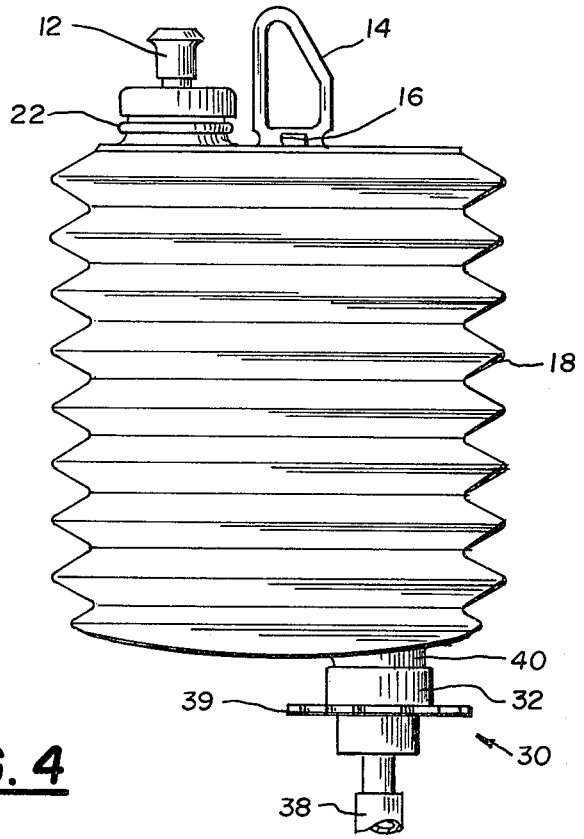
FIG. 4 represents a side or face view of an expanded container with a lower swivel outlet portion of the valve in a fluid cutoff condition and with the attached hose in a coiled condition.

FIG. 4 exemplifies the container 10 in an expanded condition and filled for use. When filled the fluid may be shaken or otherwise agitated by means of the handle 14 in its lifted condition. This handle and a valve flange 39 on valve 30 is grasped for such shaking. This fluid cutoff valve 30 is secured to a discharge outlet 40 having male threads. Said valve is mountable and is retained by female threads 42 (FIG. 6) with the threads of the container and valve compatible and so orientated that when fully assembled into a fluid tight condition the swivel stem 34 or extending portion of the fluid cutoff valve 30 may be bent to about ninety degrees from the discharge axis of the outlet 40. When moved to this condition and position, fluid flow is shut off. The attached tubing 38 is coiled in a circular manner and arranged so the tubing is substantially parallel to the bottom of the container.

SWIVEL VALVE AS IN FIGS. 5, 6, 7 and 8

As seen in FIGS. 5 through 8 the fluid cutoff valve 30 is shown in enlarged scale and disengaged from the container. The valve has a protruding flange portion 39 extending from a molded body portion 32. A through passageway 52 is formed in this body portion and in a lower portion 54 is formed swivel sockets 56 disposed to carry a swing or swivel stem portion 34. This swing or swivel portion 34 is made with like swivel ends 58 carried and movable in sized retaining sockets 56. The plastic used in both body portion 32 and swivel portion 34 is selected from fluid impervious material which is slidable on itself. The swivel ends 58 and the sockets 56 are designed so that the rotatable swivel member 34 is rotatable within determined limits. When assembled the swivel ends 58 are a friction fit in sockets 56 and in a mounted and assembled condition the swivel portion 34 provides a friction engagement as well as a fluid cutoff through the stem in the body portion.

Figure 5:
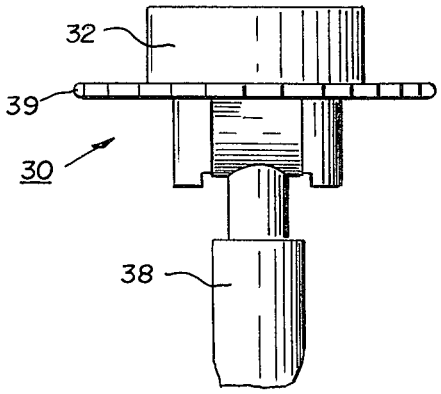
FIG. 5 represents a face view of the assembled valve in an enlarged scale and showing the relationship of two portions of the valve in an assembled condition.

In FIG. 5, a front view of the assembled fluid cutoff valve 30 is shown with the flange 39 having a scalloped or knurled rim or edge which assists in the manipulation of the flange, container and the swivel portion 34. This flange and convoluted edge provides a means for grasping the lower end of the filled container. The extending handle 14 is also grasped for shaking of the fluid contents of the container. It is assumed, of course, that the upper air valve 12 is closed during agitation and is only opened during and for discharge or withdrawal of fluid as in FIG. 4.

It is to be noted that the cutoff valve is depicted as separate components. The swivel portion 34 is movable into a mounted condition in the valve body portion 32 which is placed on a flat surface, not shown or identified, and this body is grasped while the swivel portion 34 is mounted by and with a forceful push which allows the swivel ends 58 to enter and be retained in the molded sockets 56. These ends are a snug fit in the sockets and the positioning of these sockets is such that the arcuate surface identified as 60 is brought into a contiguous engagement with the arcuate recess identified as 62 and provided in the body portion 32. In a mounted and swinging condition the fluid cutoff valve 30 when in the position of FIGS. 5 and 6 is substantially in full flow and when turned as in FIG. 7 the fluid flow is cut off.

Figure 6:
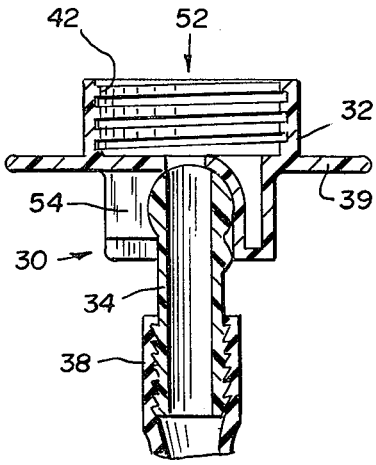
FIG. 6 represents a side view, partly in section, and diagrammatic, of the valve of FIG. 5 and with this view shown as moved to ninety degrees from the view of FIG. 5 and with the valve in a flow condition.
Figure 8:
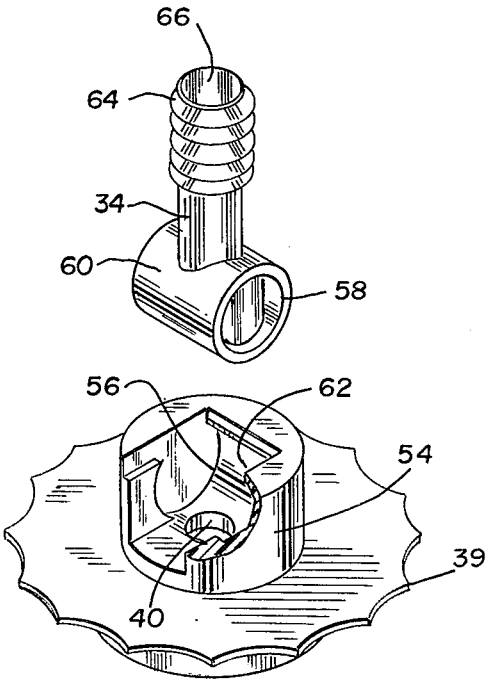
FIG. 8 represents an exploded isometric view partly diagrammatic and similar to FIG. 6 and in the same scale, the swivel end portion of the valve shown in a removed or disassembled condition for mounting in formed sockets in the body housing, the insertion of the swivel end made by force manipulation.

In FIG. 6 it is to be noted that the lower end of the swivel portion 34 is provided with barbs or like protrusions 64. On these protrusions an upper end of the tube 38 is mounted by a force fit and expansion of the resilient tube. This tube extends to the discharge end which may be a douche or enema nozzle or may be an outlet end for intravenous feeding and the like.

Figure 7:
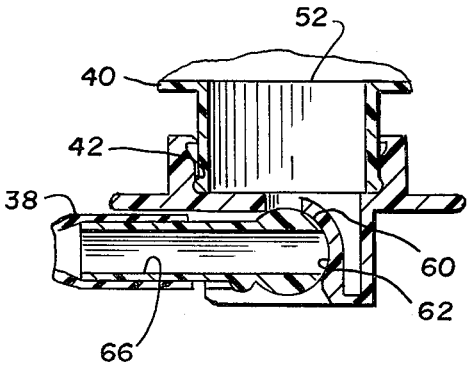
FIG. 7 represents the sectional side view of the cutoff valve as and of FIG. 6 but with the swivel portion rotated into a fluid cutoff condition and about ninety degrees from the position of FIG. 6.
Figure 11:
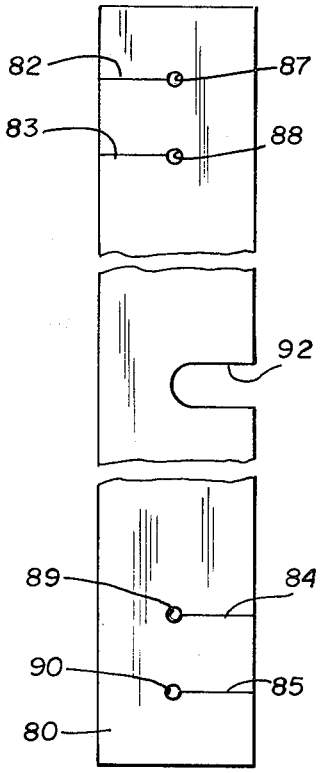
FIG. 11 represents a face view, partly fragmentary and diagrammatic and showing a strip of plastic and means for assembling and retaining the strip as a support collar.

In the shut-off condition of FIG. 7 the swivel member 34 is moved to and into a position normal to the axis of the valve body 32 whereat the valve and a passageway 66 in the swivel member is closed by the arcuate recess portion 62 coming in way of the passageway 66. In this shut-off position the fluid in the container no longer flows. The lower valve body 32 is removably mounted by threads 42 on outlet 40 and this valve is selectively opened or closed to allow or to inhibit fluid flow. This swivel fluid cutoff valve 30 replaces the cutoff provided by the bending of the tubing as in applicant's U.S. Pat. No. 4,068,662 issued Jan. 17, 1978 (FIGS. 10, 11 and 12) and also various shut-off devices that selectively pinch or otherwise close the resilient tubing 38 to stop flow therethrough.

EMBODIMENT OF FIGS. 9 AND 10

Figure 9:
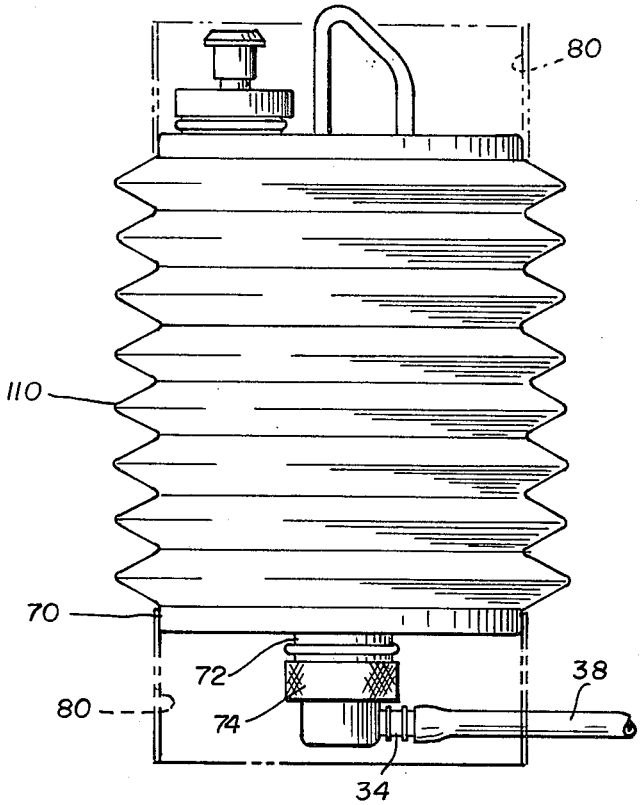
FIG. 9 represents a side or face view very similar to the view of FIG. 4 but with the outlet centrally disposed and showing the expanded container supported on an assembled strip means.
Figure 10:
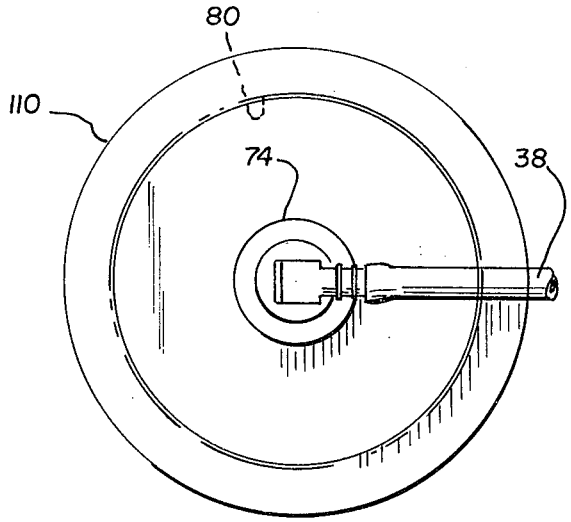
FIG. 10 represents a bottom view of the container of FIG. 9 and with a support strip arranged in a positioned attitude.

In FIGS. 9 and 10 is shown a collapsible container 110 having the top portion formed as in FIG. 4 above described. As shown the bottom of this container is formed with a boss or downwardly extending shoulder portion 70 which is of a selected diameter. The bottom of this container 110 is formed with a centrally or substantially centrally disposed outlet 72 which has a male thread adapted to receive the threads 42 in the body 32 of the cut-off valve 30 shown in FIG. 6. Flange 39 may extend as shown in FIG. 4 or be a fluted or knurled extending portion 74 as depicted in FIG. 9. Tubing 38 is connected to the swivel stem portion 34 as in FIGS. 3 and 7. The accordion pleated portion is identified as 118 and the boss 70 is preferably at about the inner diameter or extent of the pleats.

EMBODIMENT OF FIG. 11

A support for this container 110 is provided by a strip of plastic (orientated polypropylene, polyethylene, cardboard, etc.) generally identified as 80. This strip as reduced-to-practice is contemplated as being about two inches wide and about twenty inches long. This plastic strip is sufficiently rigid to provide a support collar with a thickness about fifteen to twenty thousandths of an inch. This is only suggestive dimensions and no patentable limitations are ascribed thereto. In this strip it is contemplated that at each end transverse and partial cuts 82, 83, 84 and 85 are made. It is noted that these cuts are prevented from being unduly extended by small holes 87, 88, 89 and 90 formed at the inner termination of these cuts and providing conventional means for preventing unwanted extension of said transverse cuts. A cut at one end is engaged with a cut at the other end to form an engaging lapping and retaining of this strip into the desired circular configuration. The strip 80 is shown with plural cuts at each end but this is merely a matter of preference and design.

A cutout 92 is shown as being formed intermediate the ends of the strip and this cutout is open to the longitudinal edge of the strip 80. It is contemplated that this cutout 92 may be used toward a support table or surface (not shown) and with the expanded container 110 thereabove. Conversely the cutout 92 may be disposed toward the container with the flexible tubing 38 extending therethrough. The tubing 38 may have a conventional shut-off means such as a keyhole closure member or a disk-like rolling member carried in a holder. Such cut-off devices are well known in the art. Such cut-off devices may be used when the valve 30 is open or is not effective.

USE AND OPERATION OF THE EMBODIMENT OF FIGS. 9 THROUGH 11

It is anticipated that the container 110 is filled with fluid as above described. Inlet valve 12 is removed for filling and then is closed after filling. Handle 14 and the flanged portion 39 or the knurled portion 74 is grasped for shaking, if needed, to mix the contents. The swivel valve 30 is depicted as in a closed condition. Tubing 38 extends from this valve and when and where desired a supporting collar 80 is assembled by causing cuts 82 and/or 83 to enter and engage or seat in cuts 84 and/or 85. The assembled collar may be positioned to support the container 110 at its lower end and the boss or shoulder portion 70 establishes a retaining limit for the assembled collar. This collar, as shown in phantom outline, may also be used around a like formed shoulder at the top portion of the container to support the container for draining or other purposes.

When or where the flexible tubing is to be fed through the collar, the cutout 92 is used. If a crack, space or other means in the support is available so that the tubing 38 is not required to be fed through this opening or cutout 92 then said cutout need not be used. The cutout 92 is arranged to retain the tubing either before or after placing on the support surface.

The discharge outlet is shown as offset and central and in one embodiment with the container having a boss which is adapted to retain a collar made from a lapped strip. Although cuts or slots are shown as formed in the plastic strip this does not preclude the securing together of this strip by adhesive means. The strip may also be made of impregnated cardboard providing an improvement in resistance to moisture, tearing and the like. This collar member is depicted with one cutout 92 but more than one may be provided and may be formed in opposite edges or sides. The transverse cuts depicted are merely an inexpensive method of forming a collar with a lap joint but other joining means is contemplated including a buckle and tongue, apertures and protrusion portions and notched members. All are known in the packaging art but the supplying of an auxillary collar which is assembled for supporting a collapsible container after filling is believed to be novel.

The air valve 12 is known in the prior art as is the manipulative actuation which is also contemplated. If and when the container is to be used with intravenous feeding and the like the air valve is also provided with a filter to prevent contamination of the contents. A like filter may be used with swivel valve 30, either above or below said valve, and sterilization of said valve can be provided by gas or ultra-violet light.

The collapsible container as above shown and described provides a storage means in which powder may be placed before shipment and fluid added later as in FIG. 2. Other uses for this container includes storage before the final fill and with the swivel portion turned to its storage position as in FIG. 3 with a minimum of space required.

Terms such as "up", "down", "bottom", "top", "front", "back", "in", "out" and the like are applicable to the embodiment shown and described in conjunction with the drawings. These terms are merely for the purpose of description and do not necessarily apply to the position in which the collapsible container may be used or constructed.

While a particular embodiment of the container has been shown and described it is to be understood the invention is not limited thereto and protection is sought to the broadest extent the prior art allows.

What is claimed is:

1. A collapsible container adapted to store and dispense fluid from the interior thereof, said container having means for controlling the fluid flow therefrom, said container including:

(a) a container of fluid impervious material and having accordion pleated side portions and having a downwardly extending boss or shoulder portion which is substantially the diameter of the inner extent of the accordion pleated side portions, said container adapted to provide a storage and discharge means and while in an empty condition the container may be manipulated to bring the sides into a pleated and stacked array providing a minimun stacked height;

(b) a top surface member integral with and forming an upper end closure of the container, said top surface member including an inlet opening for admitting fluid and a handle integrally attached to the top surface and adapted for folding flat toward and to the top surface and when swung to an erected condition providing manipulative and lifting means for the container;

(c) a latch carried by the top surface of the container and adapted to releasably engage and retain said handle in a folded condition;

(d) a valve and cover for said inlet opening, said valve adapted for admitting atmosphere into the filled container during withdrawal of fluid from the container and to be closed to the passage therethrough of fluid during other periods including agitation;

(e) a bottom surface member integral with and forming a lower end closure of said container, this bottom surface member having an outlet passageway formed and provided therein;

(f) a selective mountable swivel valve attachable to said outlet passageway, this swivel valve having two selectively movable interrelated portions with said portions in a localized contiguous relationship to each other, and when said swivel valve is mounted on the outlet passageway and the movable portion is in an attitude substantially in coincidence with the axis of the outlet passageway the swivel valve is open to fluid flow and when the movable portion of said valve is manipulated to an attitude substantially normal to the axis of said outlet passageway said swivel valve is closed to fluid flow;

(g) an external portion formed on the body of said swivel valve, this portion extending outwardly from said body and adapted for grasping by the hand of the user, and (h) means for attaching a selected length of resilient tubing to an extending end of the swivel portion of said valve and when said valve is moved to a shut-off condition the tubing and swivel valve are in an attitude for coiling said tubing into a minimum of extending space.

2. A collapsible container as in claim 1 in which the container, the handle and latch are molded at the same time and are integral portions thereof.

3. A collapsible container as in claim 2 in which the inlet opening is sufficient in size to permit insertion of a fluid flow spout to direct a fluid flow into the interior of the container.

4. A collapsible container as in claim 3 in which the inlet opening is formed with a shoulder or lip which protrudes from the body of the inlet opening and is sufficiently spaced from said body so that mounting of said container on a support member having a U-shaped opening into which the inlet opening is positioned provides therewith means for ease of filling by a spout.

5. A collapsible container as in claim 4 in which the support member having a U-shaped opening is of sheet metal and is secured to an exterior member.

6. A collapsible container as in claim 1 in which the swivel valve is made of molded plastic and the swivel portion of the valve is removably mounted in a body portion of the swivel valve.

7. A collapsible container as in claim 6 which is made with female threads sized and adopted to mate with male threads formed in the discharge outlet of the container and with said threads orientated and formed so that with said swivel valve in mounted and tightened condition the swivel portion is adapted to be brought adjacent the bottom of the container.

8. A collapsible container as in claim 1 in which the outwardly extending flange formed on the body of the swivel valve is formed with an outward edge having a scalloped contour so as to assist the user to grasp and manipulate said container to prevent slippage.

9. A collapsible container as in claim 8 in which the discharge outlet on the bottom of the container is near to the side of the container and in the bottom surface member.

10. A collapsible container as in claim 1 in which the swivel valve is formed with an outwardly extending flange in which an outward edge has a fluted or knurled surface so as to assist the user to grasp and manipulate said container to prevent slippage.

11. A collapsible container as in claim 1 in which the bottom surface member includes the discharge outlet which is substantially centrally positioned.

12. A collapsible container as in claim 11 in which a collar is provided for supporting the container on its bottom surface member and in a more-or-less vertical manner, said collar of thin strip material sufficiently flexible to be coiled into a tubular array and with a diameter adapted to engage and retain the formed boss on the container.

13. A collapsible container as in claim 12 in which the collar is formed with at least one transverse slits or cuts in and at each of the ends of said strip of material and from opposite side edges to provide means for effecting a lap joint, the assembled collar adapted to fit exteriorally of said boss and engage the bottom surface of the container for the supporting of the filled container.

14. A collapsible container as in claim 13 in which the collar strip includes at least one cutout intermediate the ends thereof and with said cutout or cutouts open to an edge of said strip, each cutout sufficient for the passage therethrough of a length of said resilient tubing.

15. A collapsible container as in claim 14 in which the transverse cuts at each end of the collar strip are plural in number and when these cuts are engaged the collar is arrayed as a more-or-less tubular member.

16. A collapsible container as in claim 15 in which each transverse cut includes a small aperture at the inner extent of each cut, said apertures preventing further unwanted extension of the length of the cuts when forming the lap joint.

* * * * *